US010473046B2

(12) United States Patent
Mitsuda

(10) Patent No.: US 10,473,046 B2
(45) Date of Patent: Nov. 12, 2019

(54) ENGINE SYSTEM FOR WORKING MACHINE CONFIGURED TO CONTAIN NOISE REDUCTION EQUIPMENT

(71) Applicant: YANMAR CO., LTD., Osaka-shi, Osaka (JP)

(72) Inventor: Masataka Mitsuda, Osaka (JP)

(73) Assignee: YANMAR CO., LTD., Osaka (JP)

( * ) Notice: Subject to any disclaimer, the term of this patent is extended or adjusted under 35 U.S.C. 154(b) by 0 days.

(21) Appl. No.: 15/269,699

(22) Filed: Sep. 19, 2016

(65) Prior Publication Data

US 2017/0009683 A1 Jan. 12, 2017

Related U.S. Application Data

(63) Continuation of application No. PCT/JP2015/056379, filed on Mar. 4, 2015.

(30) Foreign Application Priority Data

Mar. 18, 2014 (JP) ..... 2014-054689

(51) Int. Cl.
*F01N 3/00* (2006.01)
*F02D 41/02* (2006.01)
(Continued)

(52) U.S. Cl.
CPC ..... *F02D 41/0235* (2013.01); *F01N 1/00* (2013.01); *F01N 1/089* (2013.01); *F01N 3/021* (2013.01);
(Continued)

(58) Field of Classification Search
CPC .. F02D 41/0235; F02D 41/2487; F02D 41/26; F02D 41/263; F01N 13/0097;
(Continued)

(56) References Cited

U.S. PATENT DOCUMENTS 6,588,203 B2 * 7/2003 Hirota ..... F01N 1/084 181/238
6,837,336 B2 * 1/2005 Gault ..... F01N 3/0211 181/258
(Continued)

FOREIGN PATENT DOCUMENTS

CN 102812217 A 12/2012
CN 102822468 A 12/2012
(Continued)

OTHER PUBLICATIONS

Office Action dated Dec. 7, 2018 for EP Application No. 15765666.1.
(Continued)

*Primary Examiner* — Hai H Huynh
*Assistant Examiner* — Gonzalo Laguarda
(74) *Attorney, Agent, or Firm* — Norton Rose Fulbright US LLP

(57) ABSTRACT

An engine system for a working machine includes an engine disposed in a main body of the working machine, an exhaust manifold coupled to the engine, a tail pipe, an exhaust-gas purification device disposed in the main body and including an exhaust-gas inlet-side housing. The exhaust-gas inlet-side housing includes an exhaust-gas inlet coupled to the exhaust manifold, and an exhaust-gas outlet-side housing including an exhaust-gas outlet coupled to the tail pipe. The exhaust-gas purification device is configured to purify exhaust gas discharged from the engine and to cause the purified exhaust gas to be discharged from the tail pipe to an outside of the engine system. The engine system is configured such that a silencer housing is disposable in the exhaust-gas inlet-side housing, the exhaust-gas outlet-side housing, or both, to attenuate exhaust sound of the engine.

11 Claims, 12 Drawing Sheets

(51) Int. Cl.

| | |
|---|---|
| ***F01N 3/10*** | (2006.01) |
| ***F01N 13/18*** | (2010.01) |
| ***F01N 3/021*** | (2006.01) |
| ***F01N 1/08*** | (2006.01) |
| ***F01N 3/023*** | (2006.01) |
| ***F01N 13/00*** | (2010.01) |
| ***F01N 1/00*** | (2006.01) |
| ***F01N 13/08*** | (2010.01) |
| ***F01N 13/10*** | (2010.01) |
| ***F02D 41/24*** | (2006.01) |
| ***F02D 41/26*** | (2006.01) |
| *E02F 9/08* | (2006.01) |

(52) U.S. Cl.

CPC ..... *F01N 3/0231* (2013.01); *F01N 3/103* (2013.01); *F01N 3/106* (2013.01); *F01N 13/0097* (2014.06); *F01N 13/082* (2013.01); *F01N 13/10* (2013.01); *F01N 13/1805* (2013.01); *F01N 13/1855* (2013.01); *F02D 41/2487* (2013.01); *F02D 41/26* (2013.01); *F02D 41/263* (2013.01); *E02F 9/0866* (2013.01); *F01N 2450/30* (2013.01); *F01N 2450/40* (2013.01); *F01N 2470/18* (2013.01); *F01N 2490/04* (2013.01); *F01N 2590/08* (2013.01); *F02D 41/029* (2013.01)

(58) Field of Classification Search

CPC .... F01N 13/082; F01N 13/10; F01N 13/1805; F01N 13/1855; F01N 1/00; F01N 1/089; F01N 3/21; F01N 3/0231; F01N 3/103; F01N 3/106

See application file for complete search history.

(56) References Cited

U.S. PATENT DOCUMENTS

| | | | | |
|---|---|---|---|---|
| 7,104,358 | B2 * | 9/2006 | Frederiksen | F01N 1/04 181/211 |
| 8,091,350 | B2 * | 1/2012 | Suzuki | F01N 3/035 60/278 |
| 8,327,629 | B2 * | 12/2012 | Masuda | B01D 46/24 60/296 |
| 2006/0156712 | A1 | 7/2006 | Buhmann et al. | |
| 2011/0154810 | A1 * | 6/2011 | Mitsuda | E02F 9/00 60/311 |
| 2013/0008528 | A1 | 1/2013 | Mitsuda et al. | |
| 2013/0097978 | A1 | 4/2013 | Nagasaka et al. | |
| 2016/0341083 | A1 | 11/2016 | Matsunaga et al. | |

FOREIGN PATENT DOCUMENTS

| | | | |
|---|---|---|---|
| DE | 102006025190 | A1 | 12/2007 |
| EP | 2143899 | A1 | 1/2010 |
| EP | 3 098 414 | A1 | 11/2016 |
| JP | 05-024915 | U | 4/1993 |
| JP | 2001-073748 | A | 3/2001 |
| JP | 2009-228516 | A | 10/2009 |
| JP | 2009-264389 | A | 11/2009 |
| JP | 2011-196343 | A | 10/2011 |
| JP | 2013-002285 | A | 1/2013 |
| WO | 2014/024929 | A1 | 2/2014 |

OTHER PUBLICATIONS

Chinese Office Action dated Apr. 27, 2018 in corresponding CN Application 201580008096.9.

* cited by examiner

ENGINE SYSTEM FOR WORKING MACHINE CONFIGURED TO CONTAIN NOISE REDUCTION EQUIPMENT

CROSS-REFERENCE TO RELATED APPLICATIONS

The present application is a continuation application of International Application No. PCT/JP2015/56379, filed Mar. 4, 2015, which claims priority to Japanese Patent Application No. 2014-54689, filed Mar. 18, 2014. The contents of these applications are incorporated herein by reference in their entirety.

BACKGROUND OF THE INVENTION

The present invention relates to an engine system for working machines.

A technology that allows a diesel particulate filter (an oxidation catalyst, a soot filter, or any other similar assembly) serving as an exhaust-gas purification device (an exhaust-gas post-processing device) to be disposed in an exhaust path for a diesel engine to allow the diesel particulate filter to purify exhaust gas discharged from the diesel engine is conventionally known (see, for example, Japanese Unexamined Patent Application Publication No. 2001-73748 and Japanese Unexamined Patent Application Publication No. 2009-228516).

Further, a technology that, in such an exhaust-gas purification device, allows an inner case to be disposed inside an outer case so as to allow the inner case and the outer case to form a double structure, and that allows an oxidation catalyst, a soot filter, or any other similar assembly to be disposed inside the inner case is conventionally known (see, for example, Japanese Unexamined Patent Application Publication No. 2009-228516).

Moreover, a technology that, in such an exhaust-gas purification device, enables an exhaust-gas inlet-side housing containing the oxidation catalyst or any other similar assembly and an exhaust-gas exhaust-side housing containing the soot filter or any other similar assembly to be separably coupled to each other via a flange through which the exhaust-gas inlet-side housing and the exhaust-gas exhaust-side housing are secured to each other by bolts is also conventionally known (see, for example, Japanese Unexamined Patent Application Publication No. 2009-228516).

SUMMARY OF THE INVENTION

With respect to a working machine having a configuration in which, as disclosed in Japanese Unexamined Patent Application Publication No. 2001-73748 and Japanese Unexamined Patent Application Publication No. 2009-228516, an exhaust-gas purification device is assembled to an engine, when such a working machine is intended to be sold as a used machine in a region where the exhaust-gas purification device is unnecessary, additional and costly processes, such as a process of particularly producing a silencer to be fit to the engine, and a process of removing the exhaust-gas purification device and assembling the silencer to the engine, are required.

Further, with respect to a working machine having a configuration in which an exhaust-gas purification device is assembled to an engine, when such a working machine is intended to be sold as a used machine in a region where the exhaust-gas purification device is unnecessary, from a functional viewpoint, in substitution for an engine controller for controlling the operation of the engine to which the exhaust-gas purification device is assembled, an engine controller for controlling the operation of the engine to which the silencer is assembled is required.

An object of the present invention is that an engine system for a working machine is provided on which enhancement resulting from consideration of the above present situation has been made.

According to a first aspect of the invention, an engine system for a working machine includes an engine disposed in a main body of the working machine, an exhaust manifold coupled to the engine, a tail pipe, an exhaust-gas purification device disposed in the main body and including an exhaust-gas inlet-side housing including an exhaust-gas inlet coupled to the exhaust manifold, and an exhaust-gas outlet-side housing including an exhaust-gas outlet coupled to the tail pipe, the exhaust-gas purification device being configured to purify exhaust gas discharged from the engine and cause the purified exhaust gas to be discharged from the tail pipe to an outside of the engine system, and a silencer housing disposed as needed in any one or both of the exhaust-gas inlet-side housing and the exhaust-gas outlet-side housing to attenuate exhaust sound of the engine.

According to a second aspect of the invention, in the engine system according to the first aspect of the invention, the exhaust-gas purification device may further include an exhaust-gas outlet cover attachably/detachably secured to the exhaust-gas outlet of the exhaust-gas exhaust-side housing. Further, the exhaust-gas inlet-side housing may include an oxidation catalyst, and the exhaust-gas exhaust-side housing may include a soot filter. In a state in which the oxidation catalyst is removed from the exhaust-gas inlet-side housing and the soot filter is removed from the exhaust-gas exhaust-side housing, the silencer housing may be allowed to be inserted into the exhaust-gas outlet-side housing from the exhaust-gas outlet of the exhaust-gas exhaust-side housing so as to be pinched and secured between the exhaust-gas outlet-side housing and the exhaust-gas outlet cover.

According to a third aspect of the invention, the engine system in the first aspect of the invention may further include an engine controller configured to control operation of the engine. Further, the engine controller may be coupled to a central administration computer or a maintenance computer via a bidirectional communication link so as to, based on an instruction from the central administration computer or the maintenance computer, allow content of a control program for the engine controller to be rewritten into content for controlling operation of the engine in a configuration in which the silencer housing is disposed.

In a configuration according to the first aspect of the invention, an engine system for a working machine includes an engine disposed in a main body of the working machine, an exhaust manifold coupled to the engine, a tail pipe, an exhaust-gas purification device disposed in the main body and including an exhaust-gas inlet-side housing including an exhaust-gas inlet coupled to the exhaust manifold, and an exhaust-gas outlet-side housing including an exhaust-gas outlet coupled to the tail pipe, the exhaust-gas purification device being configured to purify exhaust gas discharged from the engine and cause the purified exhaust gas to be discharged from the tail pipe to an outside of the engine system, and a silencer housing disposed as needed in any one or both of the exhaust-gas inlet-side housing and the exhaust-gas outlet-side housing to attenuate exhaust sound of the engine. This configuration, therefore, makes it unnecessary to particularly produce a silencer to be fit to the engine, and facilitates the change of an exhaust-gas discharging structure for the engine for remodeling from a working machine (engine) conforming to an exhaust-gas purification specification into a working machine (engine) conforming to a silencer specification. Further, this configuration facilitates not only selling such a working machine as a used machine in a work or a region in which the exhaust-gas purification device is unnecessary, but also reducing the cost of selling such a working machine as a used machine.

In a configuration according to the second aspect of the invention, in the engine system according to the first aspect of the invention, the exhaust-gas purification device further includes an exhaust-gas outlet cover attachably/detachably secured to the exhaust-gas outlet of the exhaust-gas exhaust-side housing. Further, the exhaust-gas inlet-side housing includes an oxidation catalyst, and the exhaust-gas exhaust-side housing includes a soot filter. In a state in which the oxidation catalyst is removed from the exhaust-gas inlet-side housing and the soot filter is removed from the exhaust-gas exhaust-side housing, the silencer housing is allowed to be inserted into the exhaust-gas outlet-side housing from the exhaust-gas outlet of the exhaust-gas exhaust-side housing so as to be pinched and secured between the exhaust-gas outlet-side housing and the exhaust-gas outlet cover. This configuration not only facilitates the work of detaching the exhaust-gas outlet cover and disassembling the exhaust-gas purification device (i.e., removing the oxidation catalyst and the soot filter) and the work of assembling the silencer housing and attaching the exhaust-gas outlet cover, but also facilitates changing the exhaust-gas discharging structure for the engine from an exhaust-gas discharging structure in accordance with an exhaust-gas purification specification into an exhaust-gas discharging structure in accordance with a silencer specification almost without changing the external view and shape of the engine in accordance with the exhaust-gas purification specification.

In a configuration according to the third aspect of the invention, the engine system in the first aspect of the invention further includes an engine controller configured to control operation of the engine. Further, the engine controller is coupled to a central administration computer or a maintenance computer via a bidirectional communication link so as to, based on an instruction from the central administration computer or the maintenance computer, allow content of a control program for the engine controller to be rewritten into content for controlling operation of the engine in a configuration in which the silencer housing is disposed. With this configuration, the utilization of the engine controller for the engine in the configuration in which the exhaust-gas purification device is disposed enables control of operation of the engine for the configuration in which the silencer housing is mounted. An engine controller for the engine in the configuration in which the silencer housing is disposed is not needed to be particularly provided. Remodeling into a working machine for use in, for example, work content or a work place in which the exhaust-gas purification device is unnecessary is facilitated. Further, not only the sale of a remodeled working machine including the silencer housing and handled as a used machine is facilitated, but also the reduction of the cost of the sale of the remodeled working machine, including the silencer housing, is facilitated. Further, the exhaust-gas inlet-side housing includes an oxidation catalyst, and the exhaust-gas exhaust-side housing includes a soot filter. In a state in which the oxidation catalyst is removed from the exhaust-gas inlet-side housing and the soot filter is removed from the exhaust-gas exhaust-side housing, the silencer housing is allowed to be inserted into the exhaust-gas outlet-side housing from the exhaust-gas outlet of the exhaust-gas exhaust-side housing so as to be pinched and secured between the exhaust-gas outlet-side housing and the exhaust-gas outlet cover. This configuration not only facilitates the work of detaching the exhaust-gas outlet cover and disassembling the exhaust-gas purification device (i.e., removing the oxidation catalyst and the soot filter) and the work of assembling the silencer housing and attaching the exhaust-gas outlet cover, but also facilitates changing the exhaust-gas discharging structure for the engine from an exhaust-gas discharging structure in accordance with an exhaust-gas purification specification into an exhaust-gas discharging structure in accordance with a silencer specification almost without changing the external view and shape of the engine in accordance with the exhaust-gas purification specification.

DESCRIPTION OF THE EMBODIMENTS

Figure 1:
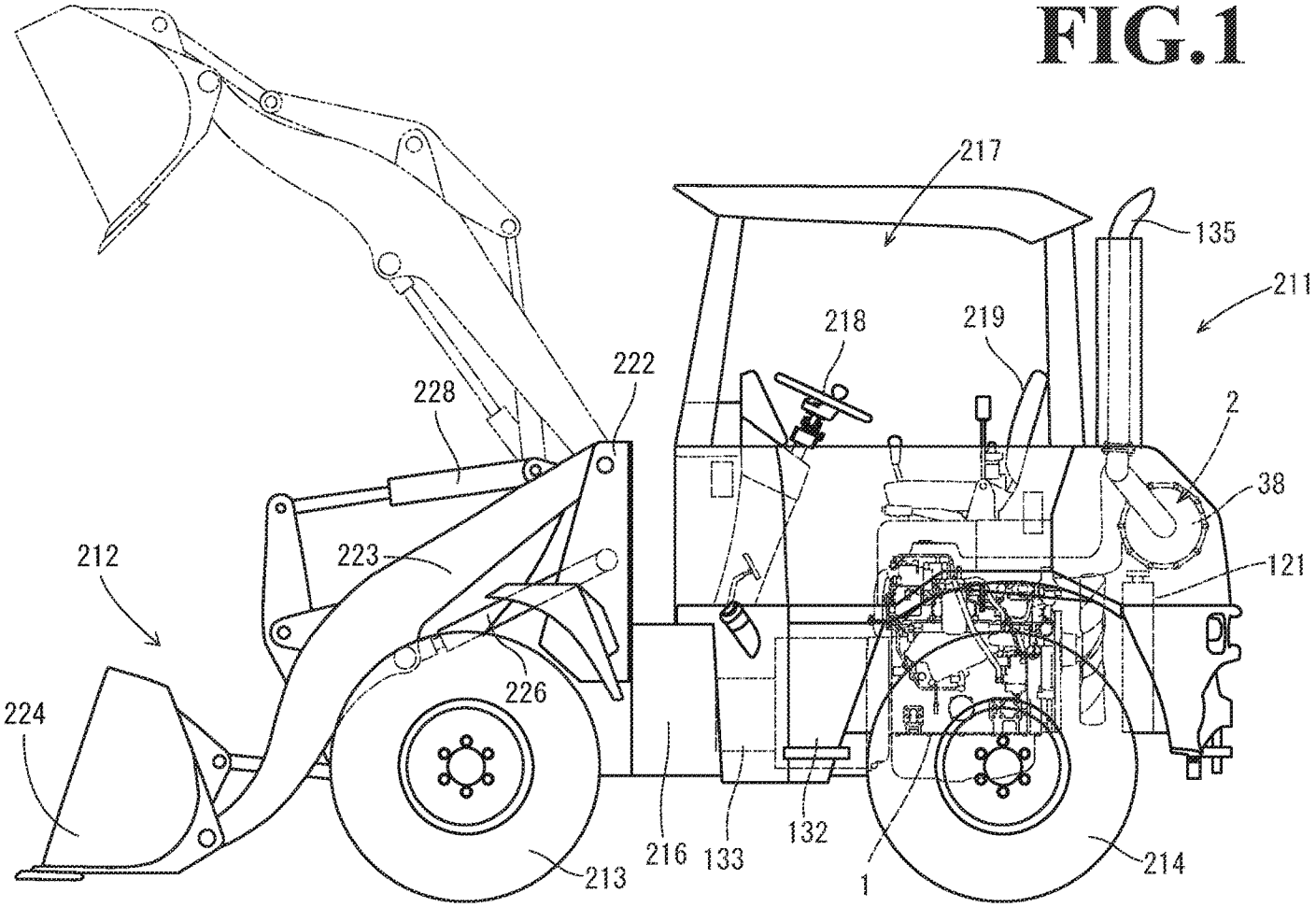
FIG. 1 is a side view of a skid steer loader according to a first embodiment of the present invention.

Hereinafter, a first embodiment of the engine system according to the present invention will be described with reference to FIGS. 1 to 8. A diesel engine 1 is mounted in a construction machine, a civil engineering machine, an agricultural machine, a cargo handling machine, or any other working machine, and serves as a prime mover for such a working machine. The diesel engine 1 is coupled to an exhaust-gas purification device 2 (a diesel particulate filter) and this exhaust-gas purification device 2 is of a continuously regenerating type. The exhaust-gas purification device 2 is configured to remove particulate matter (PM) contained in exhaust gas discharged from the diesel engine 1, and additionally, reduce carbon monoxide (CO) and hydrocarbon (HC) that are contained in the exhaust gas discharged from the diesel engine 1.

A structure of a skid steer loader 211, serving as a working machine and mounting the diesel engine 1, will be described with reference to FIGS. 1 and 2. This skid steer loader 211, shown in FIGS. 1 and 2, includes a travelling machine body 216, and this travelling machine body 216 includes a pair of left and right, front wheels 213 and a pair of left and right, rear wheels 214. The diesel engine 1 and a steering unit 217 are mounted in the travelling machine body 216. The skid steer loader 211 is configured to mount a loader device 212, serving as a working unit, in the front-side portion of the travelling machine body 216 so as to be able to carry out a loader work. The steering unit 217 includes a steering seat 219, a steering handle 218, levers/switches, and any other component. The steering seat 219 is a seat on which an operator sits, and the levers/switches serve as operation means for output operating the diesel engine 1 and any other component, and also serve as operation means for the loader device 212.

In the front portion above the pair of front wheels 213 in the skid steer loader 211, the loader device 212, serving as a working unit as described above, is disposed. The loader device 212 includes loader posts 222, a pair of left and right, lift arms 223, and a bucket 224. The loader posts 222 are disposed at both of the left and right sides of the travelling machine body 216. The left and right, lift arms 223 are coupled to the upper end portions of the respective loader posts 222 so as to be upwardly and downwardly pivotable. The bucket 224 is coupled to the front end portions of the respective left and right, lift arms 223 so as to be upwardly and downwardly pivotable.

Lift cylinders 226 are disposed between the loader posts 222 and the lift arms 223, each associated with a corresponding one of the loader posts 222, to allow the lift arms 223 to pivot upwardly and downwardly. A bucket cylinder 228 is disposed between the bucket 224 and the left and right, lift arms 223 to allow the bucket 224 to pivot upwardly and downwardly. In this case, a configuration is made such that operations of loader levers (omitted from illustration) by an operator on the steering seat 219 elongate and contract the lift cylinders 226 and the bucket cylinder 228 to cause the lift arms 223 and the bucket 224 to pivot upwardly and downwardly so as to allow the loader work be carried out.

As shown in FIGS. 1 to 7, in the skid steer loader 211, configured in such a manner, the diesel engine 1 is disposed below the steering seat 219, and the exhaust-gas purification device 2 (a exhaust-gas purification housing 38) is disposed behind the diesel engine 1 (a radiator 121). Accordingly, this configuration leads to a configuration that allows an exhaust tube 72, an exhaust tube interconnecting the diesel engine 1 and the exhaust-gas purification device 2, to extend backwardly from the right side of the diesel engine 1 (the radiator 121) so as to allow the exhaust-gas purification device 2 to be disposed remotely to the diesel engine 1. Further, a tail tube 135, a tail tube coupled to the exhaust-gas purification device 2, is configured to extend upwardly from the exhaust-gas purification device 2 in the left-side portion behind the steering seat 219. This configuration leads to a configuration that allows exhaust gas discharged the exhaust-gas purification device 2 to pass through the tail tube 135 and then be discharged upwardly behind the steering seat 219.

Figure 3:
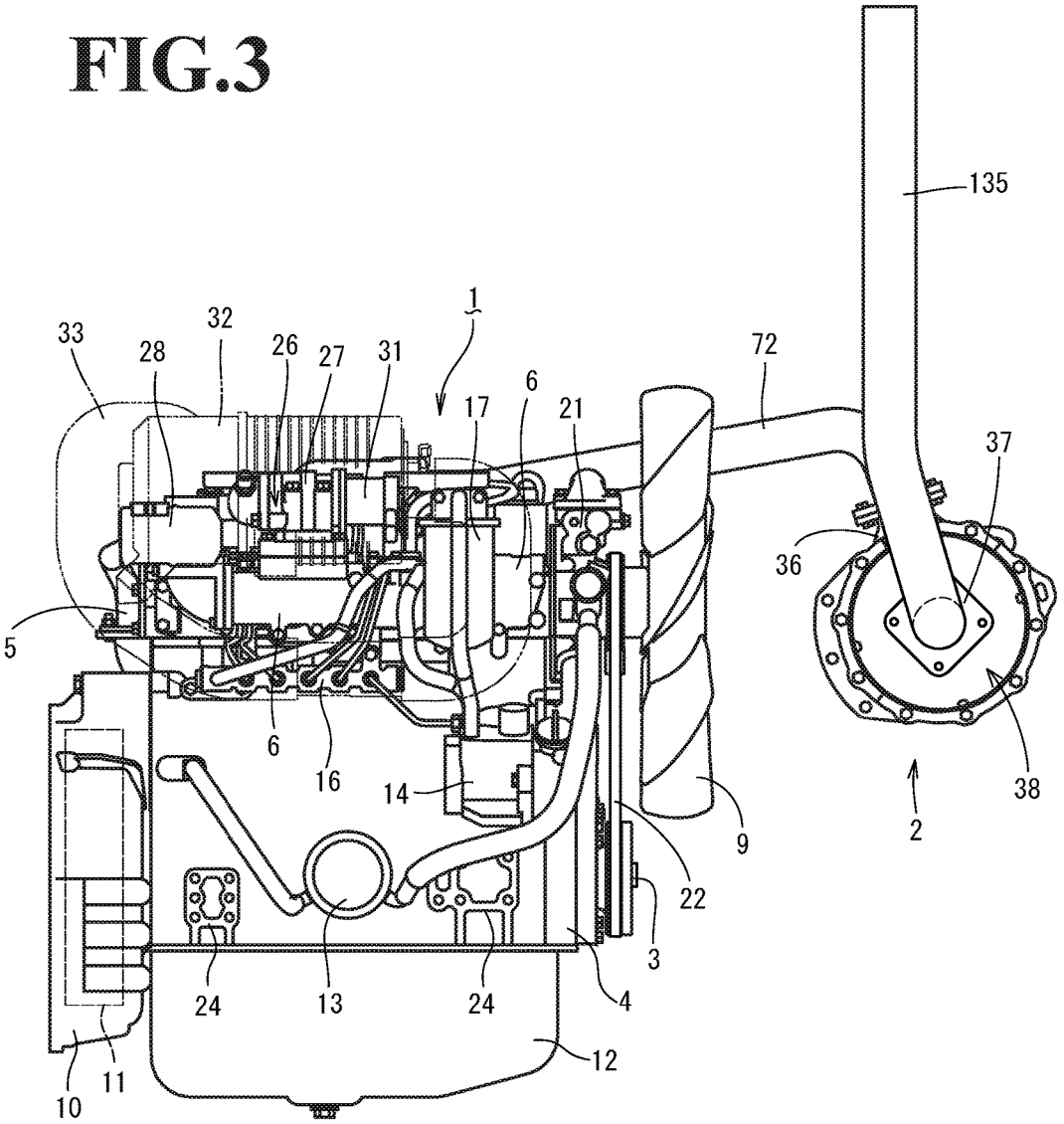
FIG. 3 is a right side view of a diesel engine in a configuration including an exhaust-gas purification device and conforming to an exhaust-gas purification specification.
Figure 4:
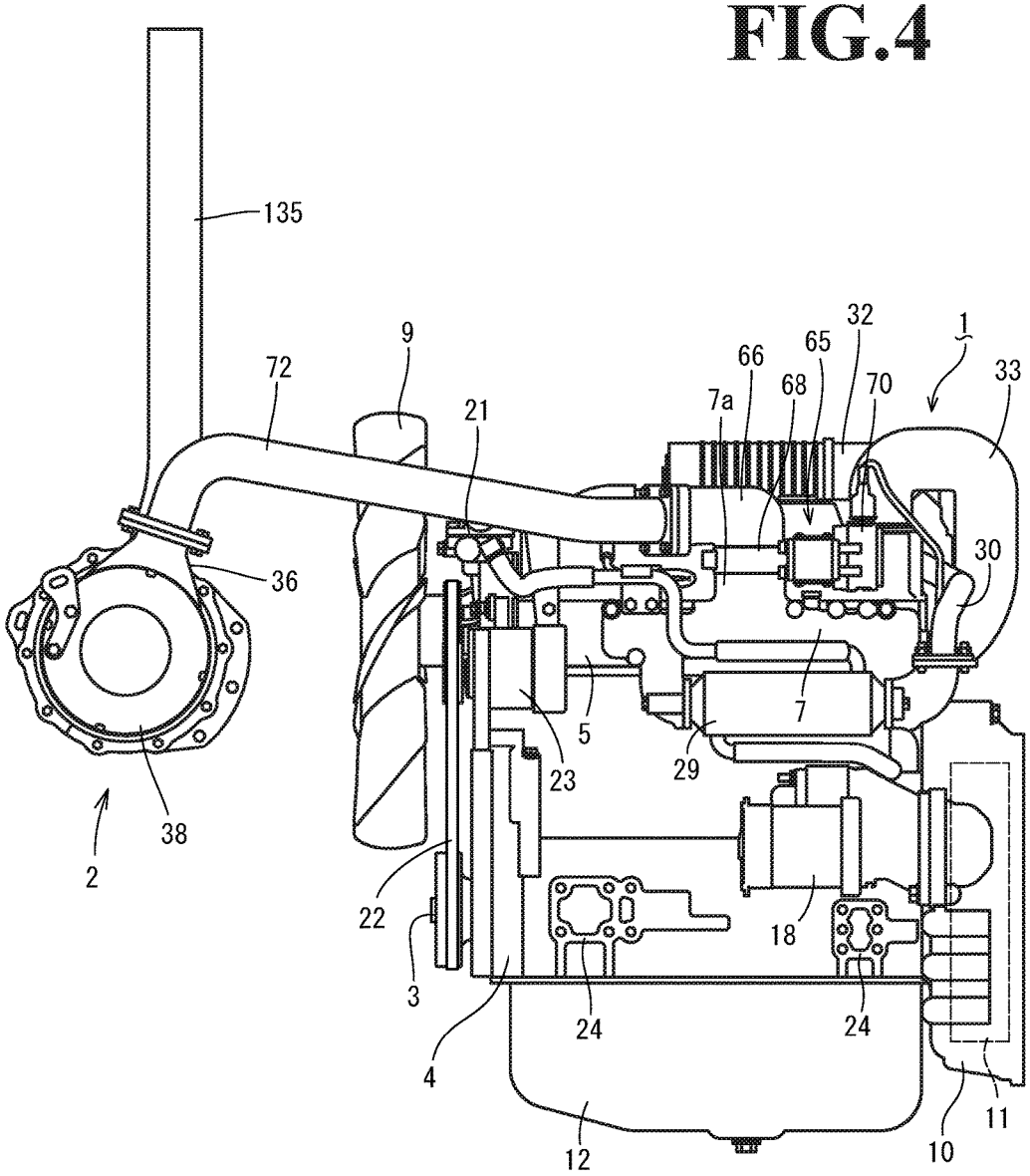
FIG. 4 is a left side view of the same diesel engine.
Figure 5:
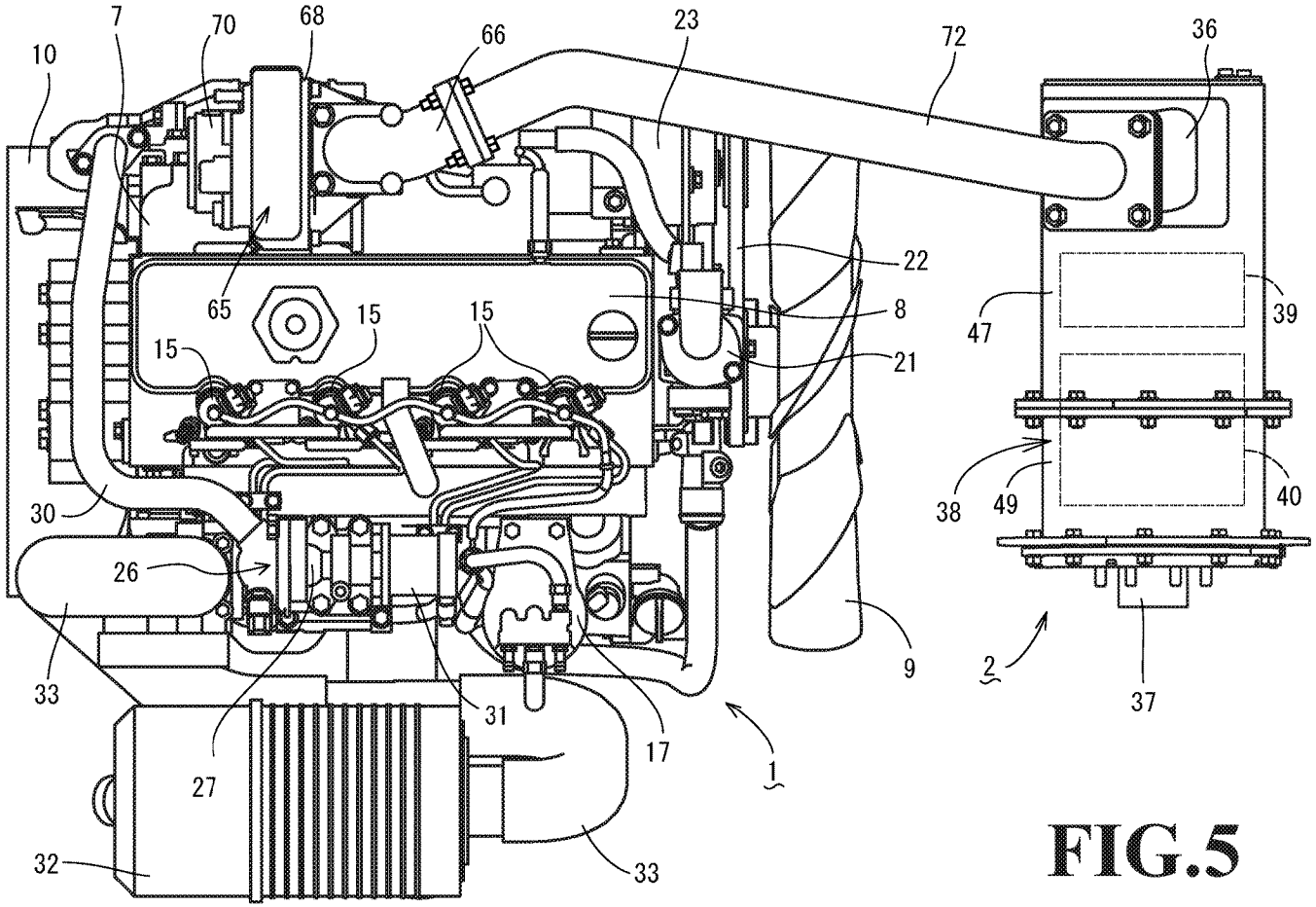
FIG. 5 is a plan view of the same diesel engine.
Figure 6:
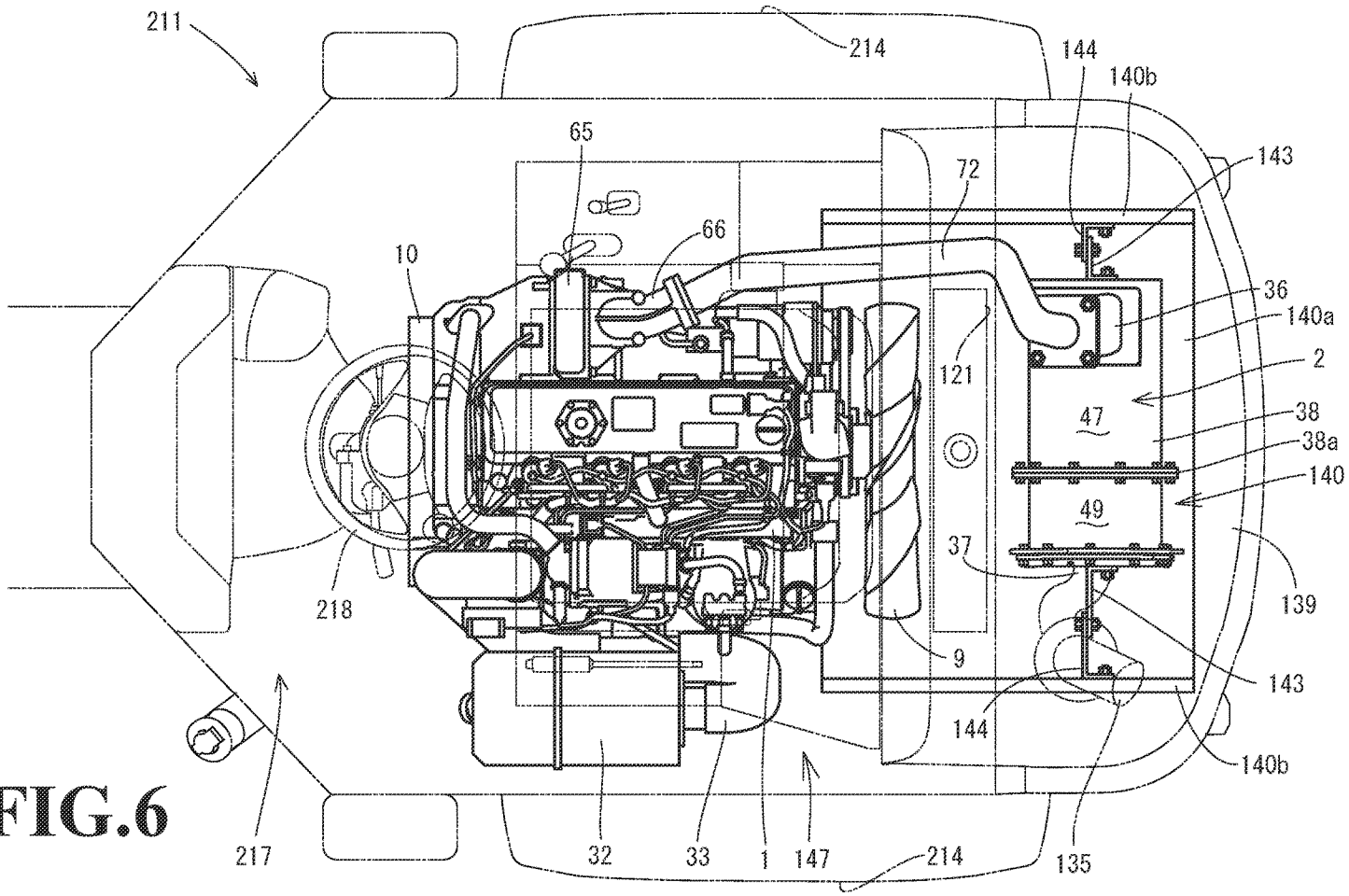
FIG. 6 is a plan view of a skid steer loader illustrating the configuration of the skid steer loader.

Next, the structure of the diesel engine 1 and the structure of the exhaust-gas purification device 2 will be described with reference to FIGS. 3 to 8. As shown in FIGS. 3 to 5, the diesel engine 1 includes a cylinder block 4, and this cylinder block 4 incorporates a crank shaft 3 and pistons (omitted from illustration). The crank shaft 3 and the pistons are used for engine output. A cylinder head 5 is mounted on the cylinder block 4. An intake manifold 6 is disposed on the right side face of the cylinder head 5. An exhaust manifold 7 is disposed on the left side face of the cylinder head 5. A head cover 8 is disposed one the upper side face of the cylinder 5. A cooling fan 9 is disposed on the front side face of the cylinder block 4 (at the front side of the diesel engine 1). A flywheel housing 10 is disposed on the back side face of the cylinder block 4 (at the back side of the diesel engine 1). A flywheel 11 is disposed inside the flywheel housing 10.

The flywheel 11 is secured to the back side of the crank shaft 3 (engine output shaft) so as to be able to rotate together with the crank shaft 3. A configuration is made such that the power of the diesel engine 1 is drawn and transmitted to the working unit of the skid steer loader 211, serving as a working machine, via the crank shaft 3. Further, an oil pan 12 is disposed under the lower face of the cylinder block 4. An oil filter 13 is disposed on the side face of the cylinder block 4, and lubrication oil inside the oil pan 12 is supplied to individual lubrication units of the diesel engine 1 via the oil filter 13.

A fuel supply pump 14, for use in the supply of fuel, is secured to the portion located on the side face of the cylinder block 4 and located above the oil filter 13 (below the intake manifold 6). Injectors 15 each associated with a corresponding one of four cylinders are disposed in the diesel engine 1. Each of the injectors 15 includes a fuel ejection valve (omitted from illustration) of an electromagnetic open/close control type. A fuel tank (omitted from illustration) mounted in the skid steer loader 211 is coupled to the individual injectors 15 via the fuel supply pump 14, a common rail 16, having a cylindrical shape, and a fuel filter 17.

Fuel of the fuel tank is flown in a pressurized state from the fuel supply pump 14 to the common rail 16 via the fuel filter 17, and the highly pressurized fuel is stored in the common rail 16. The open/close control of the fuel ejection valve of each of the injectors 15 allows the highly pressurized fuel inside the common rail 16 to be ejected from the each of the injectors 15 to a corresponding one of the cylinders of the diesel engine 1. The skid steer loader 211 is configured to, through the electronic control of the fuel ejection valve of each of the injectors 15, perform high-accuracy control of the ejection pressure, ejection timing, ejection period (ejection amount) of the fuel so as to minimize nitrogen oxide (NOx) discharged from the diesel engine 1.

In the upper front portion of the cylinder block 4, a cooling water pump 21, for use in circulating cooling water, is disposed concentrically with the fan shaft of the cooling fan 9. The rotation of the clank shaft 3 drives the cooling fan 9 and the cooling water pump 21 via a cooling-fan driving V belt 22. Cooling water inside the radiator 121, mounted in the skid steer loader 211, is supplied to the cooling water pump 21 by the drive of the cooling water pump 21. Further, the cooling water is supplied to the cylinder block 4 and the cylinder head 5 to cool the diesel engine 1. An alternator 23 is disposed at the left side of the cooling water pump 21.

Engine leg securing portions 24 are disposed on each of the left and right, side faces of the cylinder block 4. An engine leg assembly 137 (see FIG. 7) is bolted to each of the engine leg securing portions 24, and the engine leg assembly 137 includes a rubber vibration isolator 136. The diesel engine 1 is supported in a vibration-isolating manner by an engine securing chassis 138 of the skid steer loader 211 via the individual engine leg assemblies 137.

Moreover, an EGR device 26 (an exhaust-gas recirculation device) will be described. A fresh air introduction tube 33 of an air cleaner 32 is coupled to an upwardly projecting inlet portion of the intake manifold 6 via the EGR device 26 (the exhaust-gas recirculation device). Fresh air (external air) is sent from the air cleaner 32 to the intake manifold 6 via the EGR device 26.

The EGR device 26 includes an EGR body case 27 (a collector), an inlet throttle member 28, a recirculation exhaust gas tube 30, and an EGR valve member 31. The EGR body case 27 mixes part of the exhaust gas discharged from the diesel engine 1 (i.e., EGR gas from the exhaust manifold 7) with fresh air (i.e., external air from the air cleaner 32), and supplies the mixed gas to the intake manifold 6. The inlet throttle member 28 brings the EGR body case 27 into communication with the air cleaner 32. The recirculation exhaust gas tube 30 serves as a recirculation tube coupled to the exhaust manifold 7 via an EGR cooler 29. The EGR valve member 31 brings the EGR body case 27 into communication with the recirculation exhaust gas tube 30.

That is, the intake manifold 6 and the inlet throttle member 28, for use in the introduction of fresh air, are coupled to each other via the EGR body case 27. Further, the outlet side of the recirculation exhaust gas tube 30, extending from the exhaust manifold 7, is in communication with the EGR body case 27. The EGR body case is formed in a long, cylindrical shape. The inlet throttle member 28 is bolted to one longitudinal-direction end portion of the EGR body case 27. The downwardly-directed, open end portion of the EGR body case 27 is attachably/detachably bolted to the inlet portion of the intake manifold 6.

Further, the outlet side of the recirculation exhaust gas tube 30 is coupled to the EGR body case 27 via the EGR valve member 31. The inlet side of the recirculation exhaust gas tube 30 is coupled to the lower-face side of the exhaust manifold 7 via the EGR cooler 29. The amount of EGR gas supplied to the EGR body case 27 is adjusted by adjusting an aperture degree of an EGR valve (omitted from illustration) inside the EGR valve member 31.

With the above configuration, fresh air (eternal air) is supplied from the air cleaner 32 into the EGR body case 27 via the inlet throttle member 28; while EGR gas (part of the exhaust gas discharged from the exhaust manifold 7) is supplied from the exhaust manifold 7 into the EGR body case 27 via the EGR valve member 31. The fresh air from the air cleaner 32 and the EGR gas from the exhaust manifold 7 are mixed inside the EGR body case 27 and the mixed gas inside the EGR body case 27 is supplied to the intake manifold 6. That is, the above configuration is made such that part of the exhaust gas discharged from the diesel engine 1 into the exhaust manifold 7 is recirculated from the intake manifold 6 into the diesel engine 1 to decrease the highest combustion temperature in a high-load driving state so as to reduce the amount of NOx (nitrogen oxide) discharged from the diesel engine 1.

Next, the exhaust-gas purification device 2 and its attachment structure will be described with reference to FIGS. 3 to 8. The exhaust-gas purification device 2 includes the exhaust-gas purification housing 38, and the exhaust-gas purification housing 38 includes a purification inlet tube 36 and a purification outlet tube 37. In the inside of the exhaust-gas purification housing 38, a diesel oxidation catalyst 39 (a gas purification assembly) and a soot filter 40 (a gas purification assembly) are serially arranged in a movement direction of exhaust gas. The diesel oxidation catalyst 39 is made of a platinum material or any other similar material and generates nitrogen dioxide ($NO_2$). The soot filter 40 has a honeycomb structure in which collected particulate matter (PM) is continuously oxidized and removed at a relatively low temperature. The purification outlet tube 37 is coupled to the tail tube 135.

With the above configuration, the nitrogen dioxide ($NO_2$), which is generated by the oxidation behavior of the diesel oxidation catalyst 39, is supplied into the soot filter 40. The particulate matter (PM) contained in the exhaust gas of the diesel engine 1 is collected into the soot filter 40 and then is continuously oxidized and removed by the nitrogen dioxide ($NO_2$). In addition to the removal of the particulate matter (PM) contained in the exhaust gas of the diesel engine 1, the amounts of carbon monoxide (CO) and hydrocarbon (HC) that are contained in the exhaust gas of the diesel engine 1 are reduced.

Further, a thermistor-type exhaust-gas temperature sensor (omitted from illustration) or a differential pressure sensor (omitted from illustration) is additionally attached to the exhaust-gas purification housing 38. The exhaust-gas temperature sensor detects an exhaust-gas temperature at the gas-inflow-side end face or at the gas-outflow-side end face in the diesel oxidation catalyst 39. The differential pressure sensor is an exhaust-gas pressure sensor that detects a difference in pressure between exhaust gas at the upstream side and exhaust gas at the downstream side in the soot filter 40. With this configuration, the exhaust-gas purification housing 38 calculates the accumulation amount of the particulate matter in the soot filter 40 on the basis of a value of the differential pressure sensor or any other sensor value to be able to grasp a clogging state inside the soot filter 40.

Meanwhile, as shown in FIGS. 4 and 5, the skit steer loader 211 includes an exhaust-gas throttle device 65. The exhaust-gas throttle device 65 increases the pressure of the exhaust gas discharged from the diesel engine 1. The exhaust manifold 7 includes an exhaust outlet assembly 7*a*, and this exhaust outlet assembly 7*a* includes an upwardly directed opening. A relay tube 66, an elbow-shaped relay tube, is attachably/detachably coupled to the exhaust outlet assembly 7*a*, included in the exhaust manifold 7, via the exhaust-gas throttle device 65, for adjusting the pressure of the exhaust gas discharged from the diesel engine 1. The exhaust-gas throttle device 65 includes a choke valve case 68 and a water cooling case 70. The choke valve case 68 incorporates an exhaust choke valve (omitted from illustration), and the cooling case 70 incorporates components, such as an electric motor (omitted from illustration) for controlling the opening/closing of the exhaust choke valve.

That is, the exhaust manifold 7 is coupled to the above-described, exhaust-gas purification housing 38 (the exhaust-gas purification device 2) via the relay tube 66 and the exhaust-gas throttle device 65. With this configuration, the exhaust gas moves from the outlet portion of the exhaust manifold 7 into the exhaust-gas purification housing 38 via the purification inlet tube 36 to be purified in the exhaust-gas purification housing 38. Further, the purified exhaust gas moves from the purification outlet tube 37 into the tail pipe 135 and then is discharged to the outside of the machine.

Moreover, as shown FIGS. 1, 2, 6, and 7, in the inside of an engine room 147, which is constituted by a vehicle body cover 139 and any other component, the diesel engine 1, the radiator 121, and the exhaust-gas purification housing 38 are disposed on a line in an anteroposterior direction. With this configuration, cooling wind is discharged from the cooling fan 9, which is disposed at the back side of the diesel engine 1, toward the back side of the machine body 216 via the radiator 121 to cool the diesel engine 1.

For the diesel engine 1, the flywheel housing 10 is disposed so as to be located at the front side of the travelling machine body 216. That is, the diesel engine 1 is disposed so as to allow the direction of the engine output shaft 3 to be directed in an anteroposterior direction of the travelling machine body 216. A mission case 132 is coupled to the front side of the flywheel housing 10. The power of the diesel engine 1 is transmitted to the mission case 132 via the flywheel 11. In the mission case 132, the power is appropriately gear-changed, and then is transmitted to the front wheels 213 or a hydraulic drive source 133 for the cylinders 226 and 228.

Figure 7:
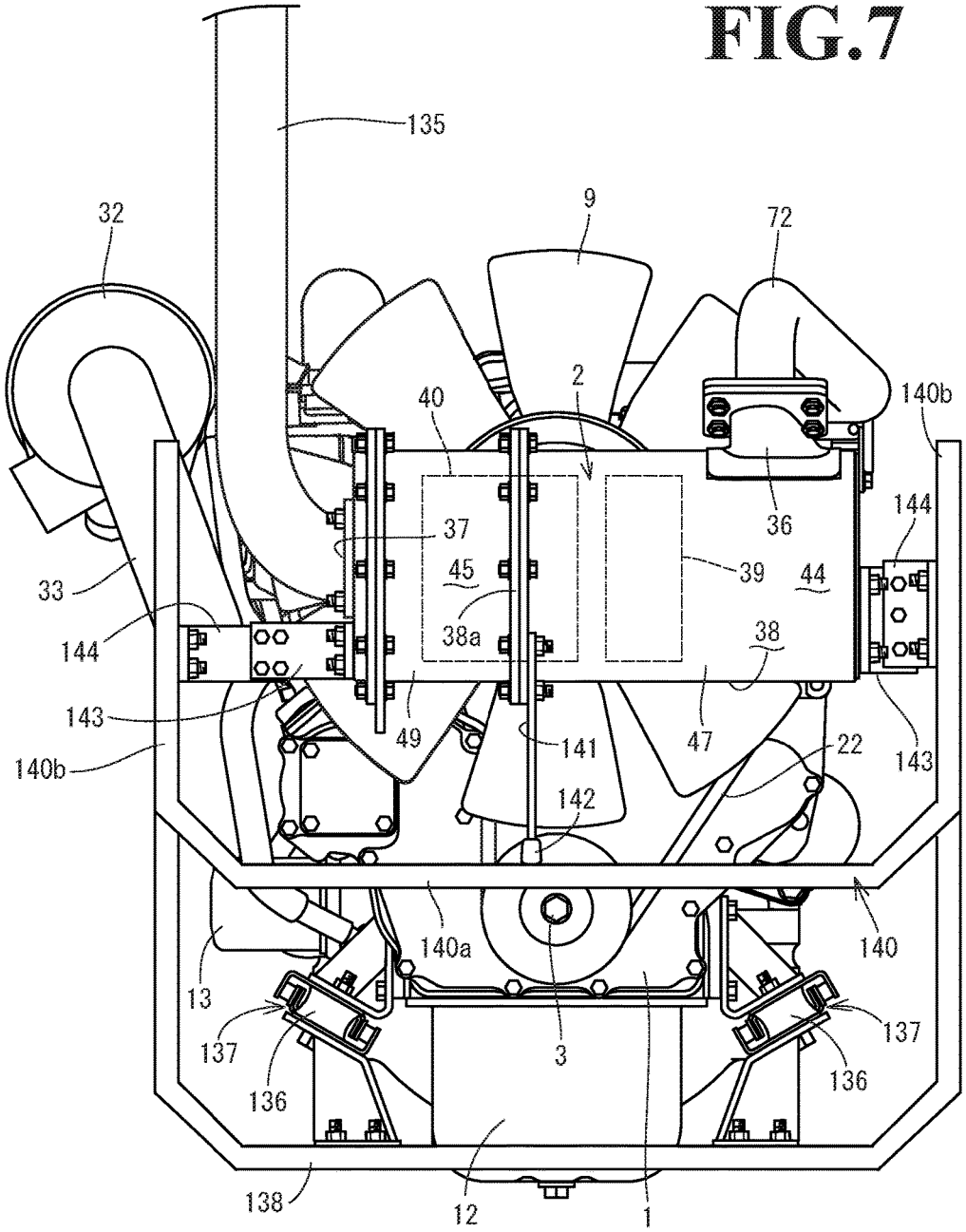
FIG. 7 is a back view of the same skid steer loader illustrating the configuration of the same skid steer loader.

As shown in FIG. 7, a machine-body rear chassis 140, having a U-shape when viewed from a back side, is formed integrally with the engine securing chassis 138, constituting part of the travelling machine body 216. The machine-body rear chassis 140 includes a horizontally disposed bottom plate 140*a* and vertically disposed left and right, side plates 140*b*. The upper end side of a central leg supporting member 141 is bolted to a central flange assembly 38*a* of the exhaust-gas purification housing 38. Further, a rubber cushion 142 is caused to be fit onto the lower end side of the central leg supporting member 141, and the lower side of the central leg supporting member 141 is brought into contact with the upper face of the bottom plate 140*a* via the rubber cushion 142.

The inlet tube 36 and the outlet tube 37 are disposed on the cylindrical-shaped outer circumference face of the exhaust-gas purification housing 38, and left and right, case side-face supporting members 143 are bolted to the left and right, end faces of the exhaust-gas purification housing 38, having a cylindrical shape long in a left-and-right direction. Further, left and right, case-receipt bracket members 144 are bolted to the inner faces of the left and right, side plates 140*b*, and the left and right, case side-face supporting members 143 are bolted to the left and right, case-receipt bracket members 144 in a way that allows securing positions to be adjustable. That is, a central portion of the leftwardly and rightwardly extending width of the exhaust-gas purification housing 38, having a cylindrical shape, is supported on the upper face of the bottom plate 140*a* via the central leg supporting member 141; while the left and right, end portions of the exhaust-gas purification housing 38, having a cylindrical shape, are coupled to the left and right, side plates 140*b* via the case side-face supporting members 143 and the case-receipt bracket members 144 so as to allow the exhaust-gas purification housing 38 to be attachably and detachably supported by the machine-body rear chassis 140.

The case side-face supporting members 143 and the case-receipt brackets 144 can be bolted to each other in a state in which the exhaust-gas purification housing 38 is supported by the bottom plate 140*a* via the central leg supporting member 141, and this configuration facilitates assembling the exhaust-gas purification housing 38 to the machine-body rear chassis 140.

In this embodiment, the longitudinal-direction other end side of the exhaust-gas purification housing 38 is constituted by a sound absorber, and the purification outlet tube 37 is disposed in the sound absorber. Each of the diesel oxidation catalyst 39 and the soot filter 40 corresponds to a filter assembly for purifying the exhaust gas.

The exhaust-gas purification housing 38 includes a catalyst case 44 and a filter case 45 The catalyst case 44 and the filter case 45 are coupled to each other via the central flange assembly 38*a*. The catalyst case 44 is formed in a double tube structure having a catalyst inner case 46 and a catalyst outer case 47. The filter case 45 is formed in a double tube structure having a filter inner case 48 and a filter outer case 49. The diesel oxidation catalyst 39 is contained inside the catalyst inner case 46. The soot filter 40 is contained inside the filter inner case 48. The outer-circumference side of the catalyst inner case 46 and the inner-circumference side of the catalyst outer case 47 are coupled to each other via a supporting member formed of a thin plate, or any other similar member.

A catalyst-side cover 53 is welded and secured to the one end side (i.e., the exhaust-gas upstream side) of the catalyst inner case 46 and the one end side (i.e., the exhaust-gas upstream side) of the catalyst outer case 47. The one end side of the catalyst inner case 46 and the one end side of the catalyst outer case 47 are blocked off by the catalyst-side cover 53. The purification inlet tube 36 is welded and secured to the outer-circumference side of the catalyst outer case 47. An exhaust-gas inlet 55 is formed in the catalyst inner case 46 and the catalyst outer case 47, and the purification inlet tube 36 communicates with the inside of the catalyst inner case 46 via the exhaust-gas inlet 55.

A catalyst flange 56 is welded and secured to the other end side (i.e., the exhaust-gas downstream side) of the catalyst inner case 46. The catalyst flange 56 has a thin-plate shape and protrudes from the outer-circumference side (i.e., the outer-radius side) of the catalyst outer case 47. The other end side of the catalyst outer case 47 is welded and secured to the outer-circumference side of the catalyst flanges 56. Meanwhile, a filter inlet flange 57 is welded and secured to the longitudinal-direction midway portion at the outer-circumference side of the filter inner case 48. The filter inlet flange 57 has a thin-plate shape and protrudes from the outer-circumference side of the filter outer case 49. The one end side (i.e., the exhaust-gas upstream side) of the filter outer case 49 is welded and secured to the outer-circumference side of the filter inlet flange 57.

Figure 8:
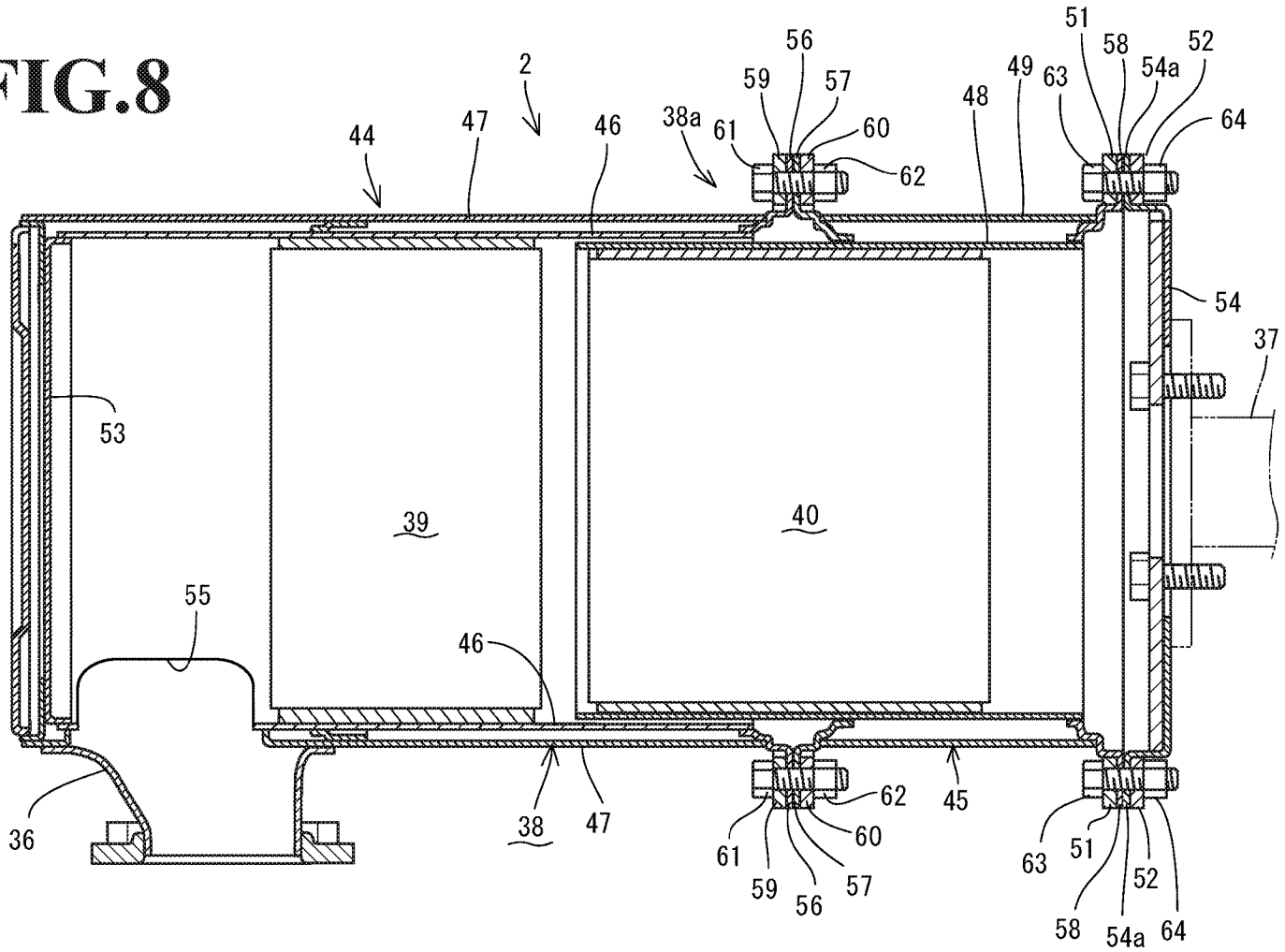
FIG. 8 is a cross-sectional view of an exhaust-gas purification housing conforming to an exhaust-gas purification specification.

As shown in FIG. 8, the catalyst flange 56 and the filter inlet flange 57 are caused to abut against each other, and both of the flanges 56 and the 57 are pinched by central pinching flanges 59 and 60 from both sides in the movement direction of the exhaust gas. The central pinching flanges 59 and 60 have thick-plate shapes and surround the outer-circumference sides of the respective outer cases 47 and 49. The central pinching flanges 59 and 60 and the flanges 56 and 57, these flanges being members serving as the central flange assembly 38*a*, are secured by bolts 61 and nuts 62 to allow the catalyst outer case 47 and the filter outer case 49 to be coupled to each other. In the state in which the catalyst outer case 47 and the filter outer case 49 are coupled to each other, the one end side of the filter inner case 48 is inserted inside from the other sides of the catalyst inner case 46 and the catalyst outer case 47. The coupling portion where the other end sides of the catalyst inner case 46 and the catalyst outer case 47 and the one end side of the filter inner case 48 are coupled to one another is configured to form a triple tube structure.

Further, the other end sides of the filter inner case 48 and the filter outer case 49, these other end sides being located at the longitudinal-direction other end side of the exhaust-gas purification housing 38, are blocked off by a filter-side cover 54. The purification outlet tube 37 is bolted and secured to the outer side of the filter-side cover 54. Additionally, a filter outlet flange 58 is welded and secured to the other end side of the filter inner case 48. The filter outlet flange 58 protrudes from the outer-circumference side of the filter outer case 49. The other end side of the filter outlet flange 49 is welded and secured to the outer-circumference side of the filter outlet flange 58.

Meanwhile, as shown in FIG. 8, a cover holding flange 54*a* is formed integrally with the filter-side cover 54. The filter outlet flange 58 and the cover holding flange 54*a* are caused to abut against each other, and both of the flanges 58 and 54*a* are pinched by outer pinching flanges 51 and 52, each having a thick-plate shape, from both sides in the movement direction of the exhaust gas. Both of the outlet pinching flanges 51 and 52 and both of the flanges 58 and 54*a* are together secured by bolts 63 and nuts 64 so as to allow the filter-side cover 54 to be coupled to the filter inner case 48 and the filter outer case 49.

Figure 9:
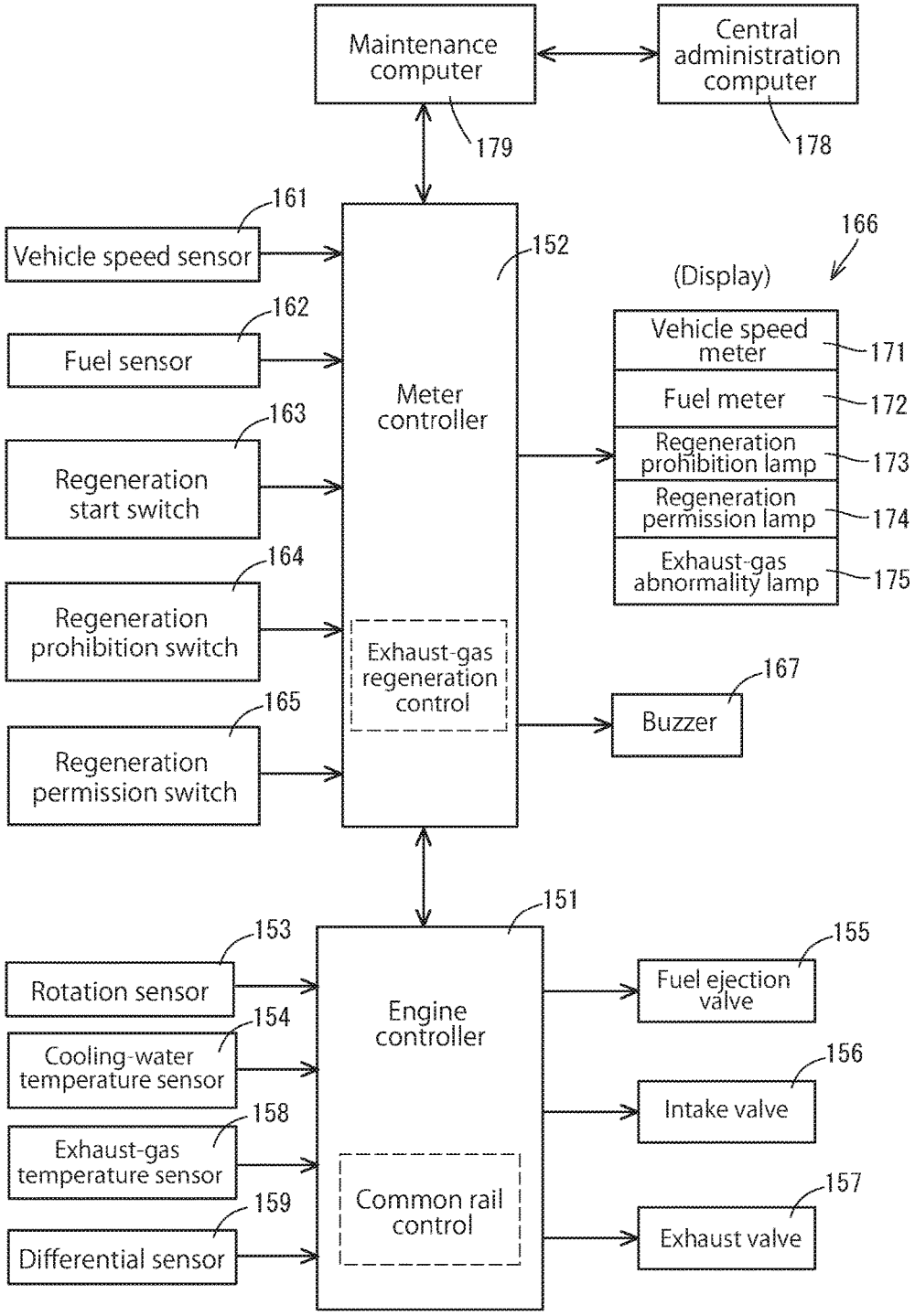
FIG. 9 is a circuit diagram of a control system for a diesel engine.

Next, the operation control of the diesel engine 1 and the regeneration control of the exhaust-gas purification device 2 (the soot filter 40) will be described with reference to FIG. 9. As shown in FIG. 9, an engine controller 151 is disposed inside a machine body in which the steering seat 219 is disposed, and a meter controller 152 is disposed inside a handle column in which the steering handle 218 is disposed. The engine controller 151 and the meter controller 152 are communicatively coupled to each other via a LAN cable through which bidirectional communication is available.

A rotation sensor 153, a cooling-water temperature sensor 154, an exhaust-gas temperature sensor 158, a differential pressure sensor 159 are input coupled to the engine controller 151, having the function of controlling the common rail 16. The rotation sensor 153 detects the number of rotations of the diesel engine 1. The cooling-water temperature sensor 154 detects a temperature of the cooling water of the diesel engine 1. The exhaust-gas temperature sensor 158 detects temperatures of the exhaust gas of the diesel engine 1 (i.e., temperatures at the exhaust-gas inlet side and outlet side of the soot filter 40). The differential pressure sensor 159 detects a difference in pressure between exhaust gas at the inlet side and exhaust gas at the outlet side in the soot filter 40. The engine controller 151 is output coupled to a fuel ejection valve 155 of the common rail 16, an intake valve 156 of the intake throttle member 28, and an ejection valve 157 of the choke valve case 68.

A vehicle speed sensor 161, a fuel sensor 162, a regeneration start switch 163, a regeneration prohibition switch 164, and a regeneration permission switch 165 are input coupled to the meter controller 152, having the function of performing the regeneration control of the soot filter 40. The vehicle speed sensor 161 detects a travelling speed of the skid steer loader 211. The fuel sensor 162 detects a remaining amount of fuel to be supplied to the diesel engine 1. The regeneration start switch 163 is a regeneration start switch for use in an interlock in which a parking brake applied state, a travelling clutch disconnected state, and any other state are detected. The prohibition switch 164 is a manually operated switch for prohibiting the regeneration control of the soot filter 40. The permission switch 165 is a manually operated switch for permitting the regeneration control of the soot filter 40. The meter controller 152 is output coupled to a display 166, for performing display on a liquid crystal display, and a buzzer 167. The display 166 includes a vehicle speed meter 171, a fuel meter 172, a regeneration prohibition lamp 173, a regeneration permission lamp 174, and an exhaust-gas abnormality lamp 175. The vehicle speed meter 171 displays a travelling speed of the skid steer loader 211. The fuel meter 172 displays a remaining amount of the fuel to be supplied to the diesel engine 1. The regeneration prohibition lamp 173 displays the ON-operation of the regeneration prohibition switch 164. The regeneration permission lamp 174 displays the ON-operation of the regeneration permission switch 165. The exhaust-gas abnormality lamp 175 displays a state of the exhaust-gas of the diesel engine 1 (i.e., an abnormal state of the temperature or the pressure of the exhaust gas).

With the above configuration, upon detection of a predetermined amount of soot accumulated in the soot filter 40 or upon detection of an elapse of a predetermined total operation time of the diesel engine 1, the exhaust-gas abnormality lamp 175 is turned on to notify this abnormal state to an operator. Further, through the control of the fuel ejection valve 155 of the common rail 16, the number of the rotations of the diesel engine 1 is caused to be automatically decreased, and this abnormal state is notified to the operator. Upon ON-operation of the regeneration permission switch 165 by the operator, the diesel engine 1 is operated at a low rotation number. Further, through the operation of halting a current work by the operator, the ON-operation of the regeneration start switch 163 is performed, and in a state in which the regeneration prohibition switch 164 is kept to an OFF state, the regeneration control of the soot filter 40 is started. The regeneration control of the soot filter 40 to remove the accumulated soot is performed by automatic control of the fuel ejection valve 155, automatic control of the intake valve 156, and automatic control of the ejection valve 157.

Figure 10:
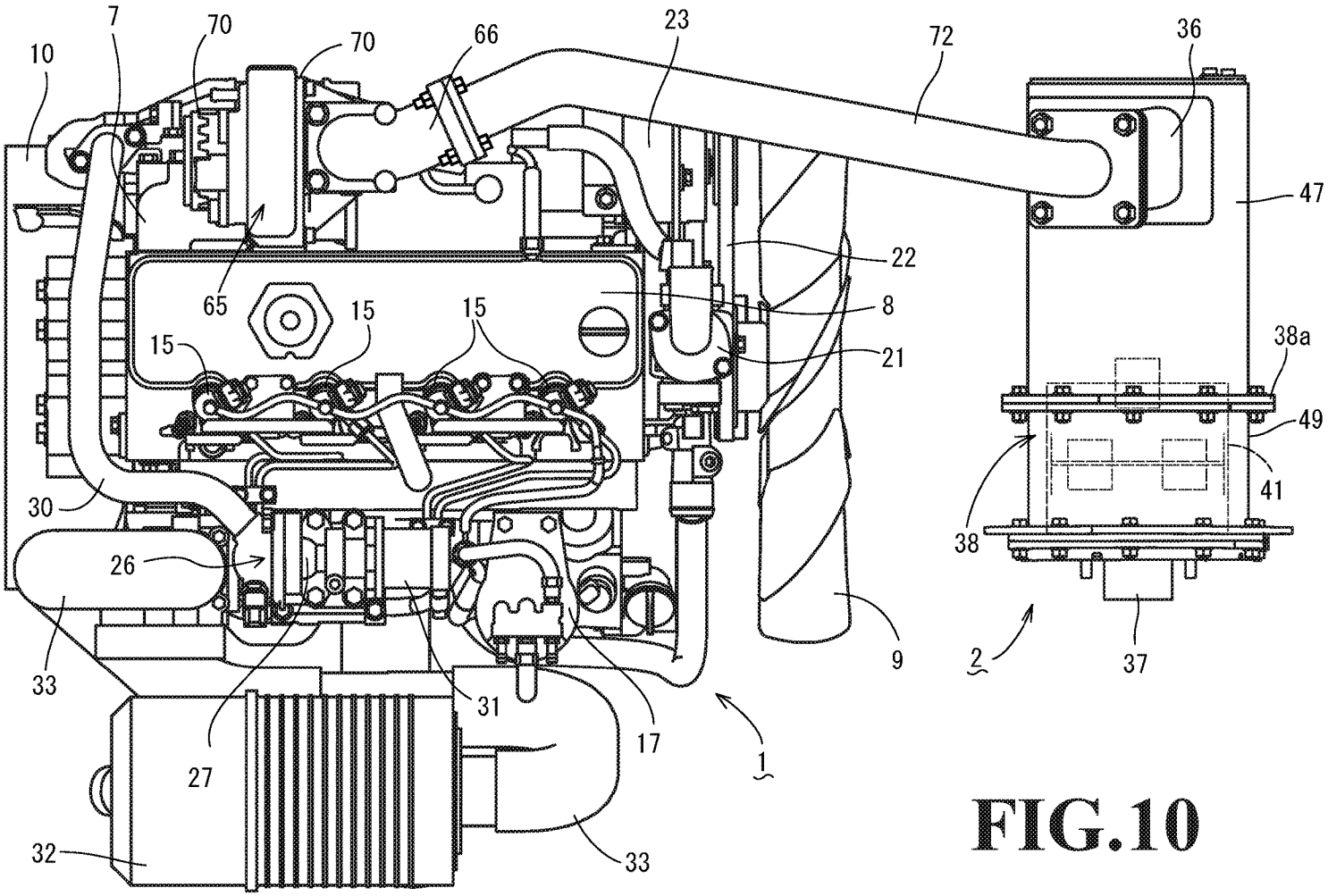
FIG. 10 is a plan view of a diesel engine illustrating a remodeled configuration including the diesel engine and conforming to a silencer specification.
Figure 11:
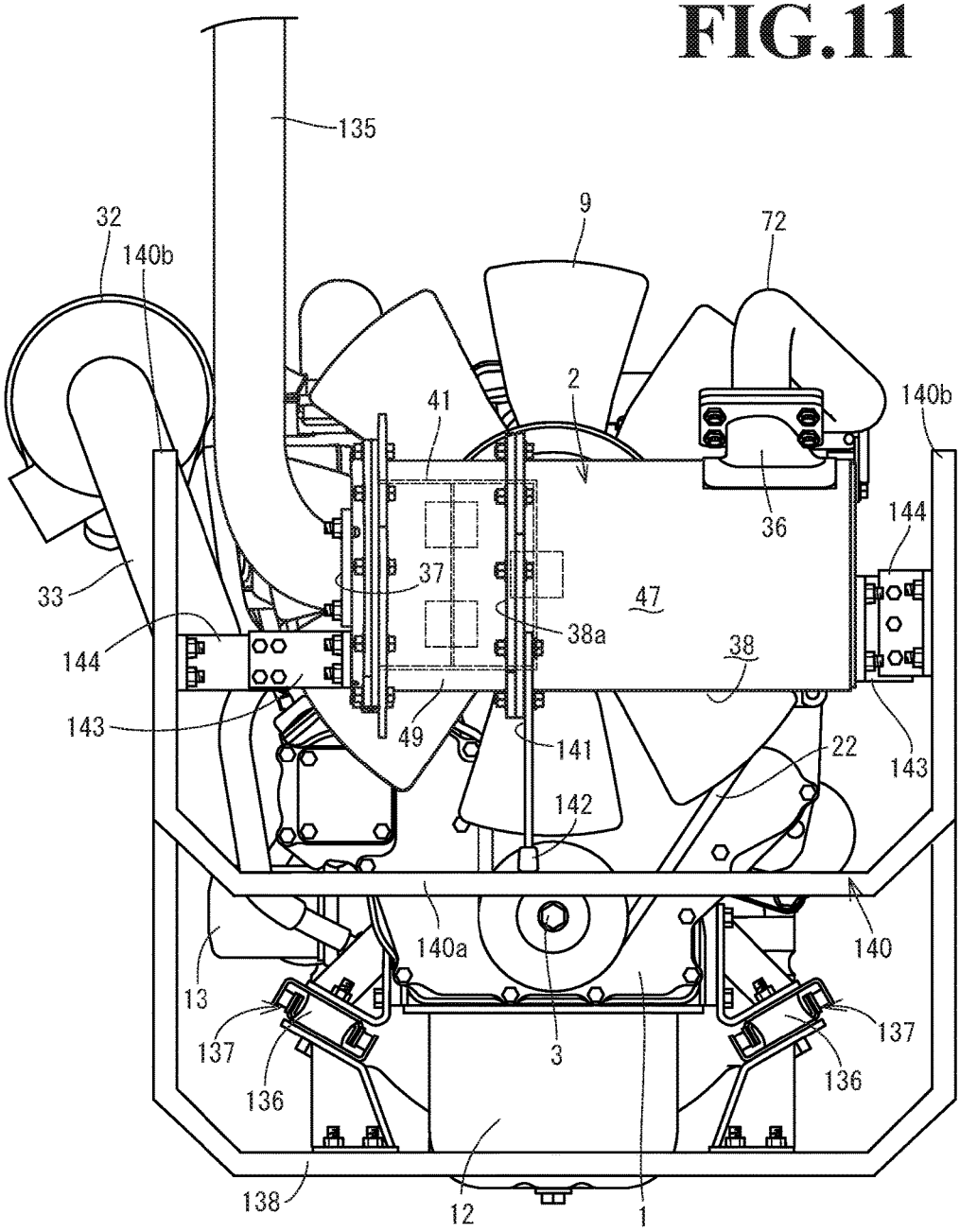
FIG. 11 is a back view of a skid steer loader illustrating the remodeled configuration, illustrated in FIG. 10 and including the diesel engine.
Figure 12:
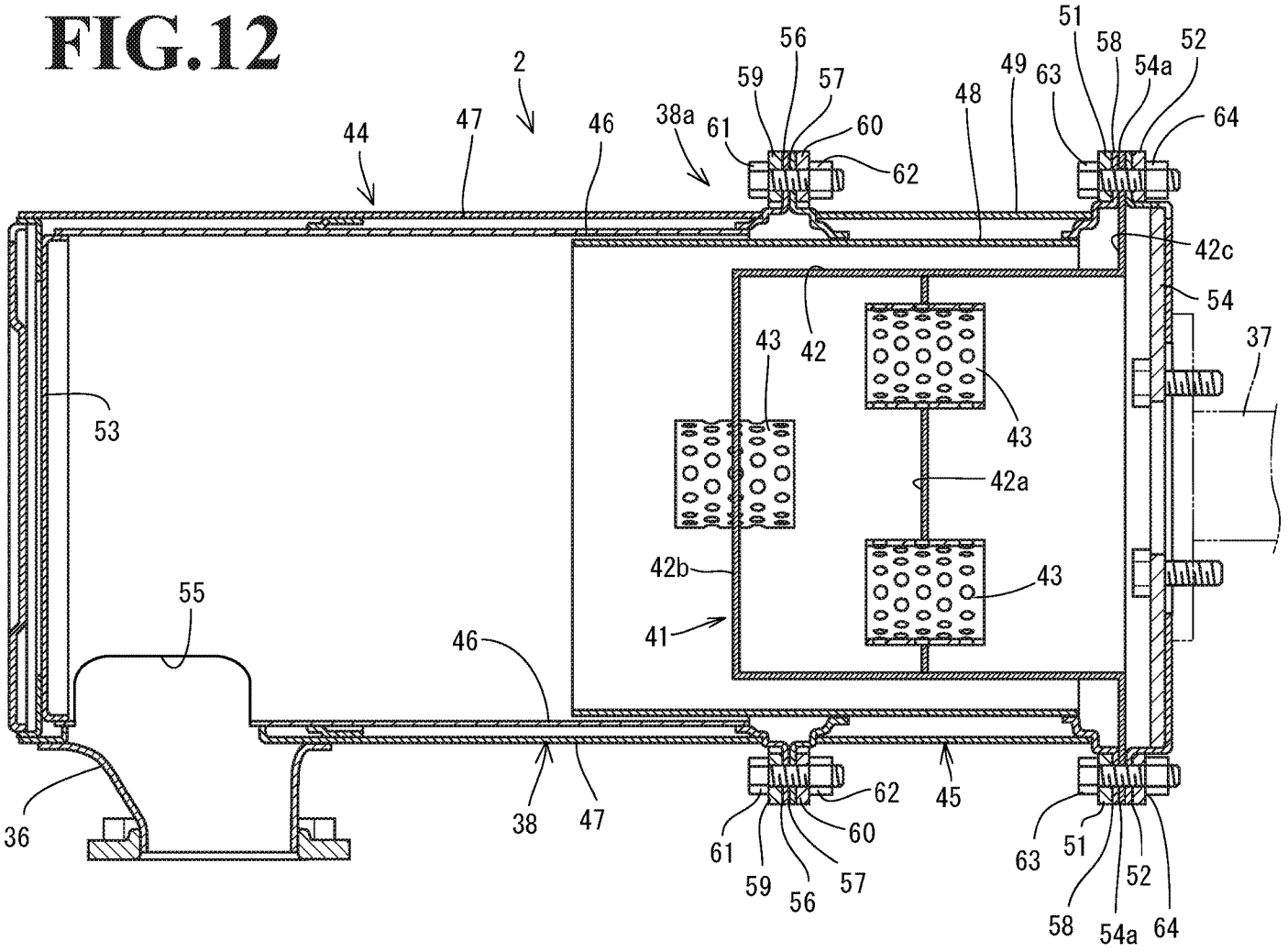
FIG. 12 is a cross-sectional view of a remodeled exhaust-gas purification housing conforming to a silencer specification.

Next, a structure in which an exhaust-gas purification device 2 conforming to a silencer specification is mounted will be described with reference to FIGS. 10 to 12. As shown in FIGS. 10 to 12, with the operations of detaching and attaching the filter-side cover 54, in a state in which the diesel oxidation catalyst 39 inside the catalyst inner case 46 and the soot filter 40 inside the filter inner case 48 are removed, a silencer 41 is disposed in the exhaust-gas exhaust side of the exhaust-gas purification housing 38. The silencer 41 includes a sound-absorbing case 42, and this sound-absorbing case 42 is inserted into the filter inner case 48. A partition wall 42*a* is welded and secured inside the sound-absorbing case 42. A plurality of communicating tubes 43 are disposed in the partition wall 42*a* and an inner wall 42*b*. The inner wall 42*b* is disposed at the one end side of the sound-absorbing case 42. Each of the plurality of communicating tubes 43 has a large number of communicating holes. The inside of the sound-absorbing case 42 is partitioned into chambers by the partition wall 42*a*, and the chambers serve as resonance chambers communicating with each other via the plurality of communicating tubes 43.

A sound-absorbing flange 42*c* is formed integrally with the other end side (i.e., the exhaust-gas exhaust side) of the sound-absorbing case 42, The other end side of the sound-absorbing case 42 is blocked off by the filter-side cover 54. Further, the sound-absorbing flange 42*c* is caused to be pinched between the filter outlet flange 58 and the cover holding flange 54*a*, and both of the outlet pinching flanges 51 and 52, both of the flanges 58 and 54*a*, and the sound-absorbing flange 42*c* are together secured by bolts 63 and nuts 64 so as to allow the filter-side cover 54 to be coupled to the filter inner case 48 and the filter outer case 49. That is, this configuration allows exhaust gas having been invaded into the sound-absorbing case 42 via the communicating tubes 43 to pass through the communication holes of the communicating tubes 43 and the resonance chambers inside the sound-absorbing case 42 so as to allow the exhaust sound of the exhaust gas to be attenuated, and to allow the exhaust gas, having been subjected to the attenuation of the exhaust sound, to be discharged toward the tail pipe 135 from the purification outlet tube 37.

As described above, the exhaust-gas purification device 2 includes the catalyst case 44 (the exhaust-gas inlet-side housing) and the filter case 45 (the exhaust-gas exhaust-side housing). The exhaust-gas inlet of the catalyst case 44 is coupled to the exhaust manifold 7 of the diesel engine 1, and the outlet of the filter case 45 is coupled to the tail pipe 135. Meanwhile, the exhaust-gas purification device 2 is configured to be able to be equipped with the sound-absorbing case 42 (the silencer housing). The sound-absorbing case 42 is inserted in any one or both of the catalyst case 44 and the filter case 45 to attenuate the exhaust sound of the diesel engine 1.

Further, with the operations of detaching and attaching the filter-side cover 54, disposed at the exhaust-gas outlet side of the filter case 45, in a state in which the oxidation catalyst 39 is removed from the inside of the catalyst case 44 and the soot filter 40 is removed from the inside of the filter case 45, the sound-absorbing case 42 is inserted into the filter case 45 from the exhaust-gas outlet side, and the sound-absorbing case 42 is caused to be pinched and secured between the filter case 45 and the exhaust-gas outlet cover 54 so as to allow the exhaust-gas discharging structure for the diesel engine 1 to be changed to remodel the working machine 211 (diesel engine 1) conforming to an exhaust-gas purification specification into the working machine 211 (diesel engine 1) conforming to a silencer specification.

As shown in FIG. 9, the engine controller 151 is coupled to a central administration computer 178 and a maintenance computer 179 via a communication link through which bidirectional communication is available. The central administration computer 178 is installed at a place where the diesel engine 1 has been produced, and the maintenance computer 179 is installed at a place where the exhaust-gas discharging structure for the diesel engine 1 is to be changed to the exhaust-gas discharging structure for the working machine 211 conforming to the silencer specification. Further, a configuration is made such that, upon operation of the maintenance computer 179 at the place where the exhaust-gas discharging structure for the diesel engine 1 is changed to the exhaust-gas discharging structure for the working machine 211 conforming to the silencer specification, content of a control program for the engine controller 151 is rewritten into content for controlling operation of the engine 1 for a configuration in which the sound-absorbing case 42 is mounted, on the basis of an instruction from the central administration computer 178.

Figure 2:
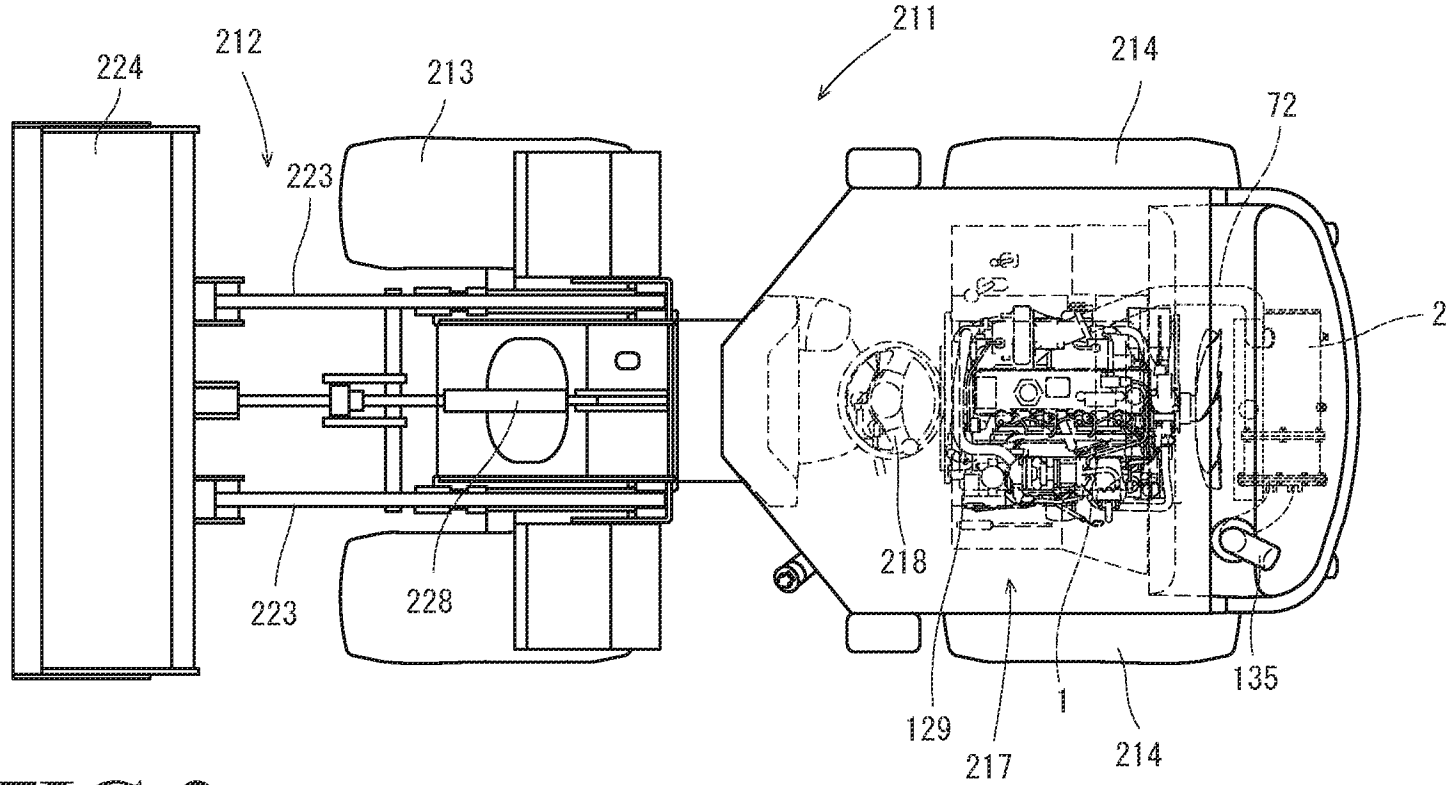
FIG. 2 is a plan view of the same skid steer loader.

As shown in FIGS. 1, 8, and 11, the engine system, for use in a working machine, includes the exhaust-gas purification device 2, which purifies exhaust gas discharged from the diesel engine 1 and is disposed in a main body of the working machine, in which the diesel engine 1 is mounted, and is configured to discharge exhaust gas discharged from the exhaust-gas purification device 2 to the outside of the apparatus through the tail pipe 135. The exhaust-gas purification device 2 includes the catalyst case 44, serving as an exhaust-gas inlet-side housing, and the filter case 45, serving as an exhaust-gas exhaust-side housing, and is structured to allow the ejection-gas inlet of the catalyst case 44 to be coupled to the ejection manifold 7 of the diesel engine 1, and to allow the outlet of the filter case 45 to be coupled to the tail pipe 135. Further, the exhaust-gas purification device 2 is configured to be able to be equipped with the sound-absorbing case 42, serving as a silencer housing for attenuating the ejection sound of the diesel engine 1, so as to allow the sound-absorbing case 42 to be inserted into any one or both of the catalyst case 44 and the filter case 45. This configuration, therefore, makes it unnecessary to particularly produce a silencer to be fit to the diesel engine 1, and facilitates the change of the exhaust-gas discharging structure for the diesel engine 1 for remodeling from a working machine (engine) conforming to an exhaust-gas purification specification into 211 (diesel engine 1) serving as a working machine conforming to a silencer specification. Further, this configuration facilitates not only selling the skid steer loader 211 (working machine) as a used machine in a work or a region in which the exhaust-gas purification device 2 is unnecessary, but also reducing the cost of selling the skid steer loader 211 as a used machine.

As shown in FIGS. 8 and 11, the exhaust-gas purification device 2 is structured to dispose the oxidation catalyst 39 inside the catalyst case 44, dispose the soot filter 40 inside the filter case 45, and include the filter-side cover 54, serving as an exhaust-gas outlet cover attachably/detachably secured to the exhaust-gas outlet side of the filter case 45. Further, the exhaust-gas purification device 2 is configured to, in a state in which the oxidation catalyst 39 is removed from the catalyst case 44 and the soot filter 40 is removed from the filter case 45, allow the sound-absorbing case 42 to be inserted from the exhaust-gas outlet side into the filter case 45, and allow the sound-absorbing case 42 to be pinched and secured between the filter case 45 and the filter-side cover 54. This configuration, therefore, not only facilitates the work of detaching the filter-side cover 54 and disassembling the exhaust-gas purification device 2 (i.e., removing the oxidation catalyst 39 and the soot filter 40) and the work of assembling the silence-absorbing case 42 and attaching the filter-side cover 54, but also facilitates changing the exhaust-gas discharging structure for the diesel engine 1 from an exhaust-gas discharging structure in accordance with an exhaust-gas purification specification into an exhaust-gas discharging structure in accordance with a silencer specification almost without changing the external view and shape in accordance with the exhaust-gas purification specification.

As shown in FIGS. 9 and 11, the engine system is structured to include the engine controller 151, for controlling the operation of the diesel engine 1, and is configured to allow the engine controller 151 to be coupled to the central administration computer and the maintenance computer via a communication link through which bidirectional communication is available, and to enable content of a control program for the engine controller 151 to be rewritten into content for controlling operation of the engine 1 for a configuration in which the sound-absorbing case 42 is mounted, on the basis of an instruction from the central administration computer or the maintenance computer. Accordingly, the utilization of the engine controller 151 for the diesel engine 1 in the configuration in which the exhaust-gas purification device 2 is mounted enables control of operation of the diesel engine 1 for the configuration in which the sound-absorbing 42 is mounted. An engine controller for the diesel engine 1 in the configuration in which the sound-absorbing case 42 is mounted is not needed to be particularly provided. Remodeling into the skid steer loader 211 (working machine) for use in, for example, work content or a work place in which the exhaust-gas purification device 2 is unnecessary, is facilitated. Further, not only the sale of a remodeled working machine (the skid steer loader 211) including the sound-absorbing case 42 and handled as a used machine is facilitated, but also the reduction of the cost of the sale of the remodeled working machine, including the sound-absorbing case 42, is facilitated.

The embodiment of the present invention relates to an engine system mounted in working vehicles, such as a skid steer loader, a backhoe, and a forklift car, agricultural machines, such as a tractor and a combine, and various working machines, such as a stationary electric generator and a freezing machine. More particularly, the embodiment of the present invention relates to an engine system used for a working machine and including an exhaust-gas purification device for purifying exhaust gas discharged from a diesel engine or any other type of engine.

What is claimed is:

1. An engine system for a working machine, the engine system comprising:

an engine disposed in a main body of the working machine;

an exhaust manifold coupled to the engine;

a tail pipe;

an exhaust-gas purification device disposed in the main body and comprising:

an exhaust-gas inlet-side housing comprising an exhaust-gas inlet coupled to the exhaust manifold and a first opening, wherein the exhaust-gas inlet-side housing defines a first through channel between the exhaust-gas inlet and the first opening, an exhaust-gas outlet-side housing coupled to the exhaust-gas inlet-side housing, the exhaust-gas outlet-side housing comprising an exhaust-gas outlet coupled to the tail pipe and a second opening, wherein the exhaust-gas outlet-side housing defines a second through channel between the second opening and the exhaust-gas outlet, and an exhaust-gas outlet cover in contact and removably coupled to the exhaust-gas outlet-side housing, the exhaust-gas purification device containing equipment to purify exhaust gas discharged from the engine, and wherein the exhaust-gas purification device is configured to cause the purified exhaust gas to be discharged from the tail pipe to an outside of the engine system; and wherein the exhaust-gas purification device is configured such that the equipment to purify the exhaust gas from the engine is removable from the first through channel, the second through channel, or both, to accommodate at least a portion of a silencer device to be positioned within the first through channel, the second through channel, or both, at a location previously occupied by a portion of the equipment to purify the exhaust gas that is removed, wherein the exhaust-gas outlet cover configured to be:

removed from being coupled in direct contact with the exhaust-gas outlet-side housing to enable the portion of the silencer device to be inserted into the second through channel via the exhaust-gas outlet, and coupled to the exhaust-gas outlet-side housing via a flange of the silencer device when the portion of the silencer device is positioned within the second through channel, and wherein the silencer device is configured to attenuate exhaust sound of the engine.

2. The engine system according to claim 1, wherein the exhaust-gas purification device further comprises an exhaust-gas outlet cover attachably/detachably secured to the exhaust-gas outlet of the exhaust-gas outlet-side housing, wherein the equipment to purify exhaust gas from the engine comprises an oxidation catalyst and a soot filter, and wherein the exhaust-gas inlet-side housing comprises the oxidation catalyst and the exhaust-gas outlet-side housing comprises the soot filter, and wherein, the silencer device comprises a silencer housing and wherein in a state in which the oxidation catalyst is removed from the exhaust-gas inlet-side housing and the soot filter is removed from the exhaust-gas outlet-side housing, the exhaust-gas purification device is configured for inserting the silencer device into the exhaust-gas outlet-side housing from the exhaust-gas outlet of the exhaust-gas outlet-side housing such that the silencer housing is pinched and secured between the exhaust-gas outlet-side housing and the exhaust-gas outlet cover.

3. The engine system according to claim 1, further comprising an engine controller configured to control operation of the engine, wherein the engine controller is configured to be coupled to a central administration computer or a maintenance computer via a bidirectional communication link so as to, based on an instruction from the central administration computer or the maintenance computer, allow content of a control program from the engine controller to be rewritten into content for controlling operation of the engine in a configuration in which the silencer device is disposed.

4. The engine system according to claim 1, wherein the portion of the silencer device is positioned within the second through channel.

5. An exhaust-gas purification device for treating exhaust gas of an engine, the exhaust-gas purification device comprising:

an exhaust-gas inlet-side housing comprising:

an exhaust-gas inlet configured to be coupled to an exhaust manifold associated with the engine; and a first opening associated with an outlet of the exhaust-gas inlet-side housing, the exhaust-gas inlet-side housing defines a first through channel between the exhaust-gas inlet and the first opening;

an exhaust-gas outlet-side housing coupled to the exhaust-gas inlet-side housing, the exhaust-gas outlet-side housing comprising:

a second opening; and an exhaust-gas outlet configured to be coupled to a tailpipe, the exhaust-gas outlet-side housing defines a second through channel between the second opening and the exhaust-gas outlet, a silencer device is configured to attenuate exhaust sound of the engine, the silencer device comprising:

a silencer housing including a portion physically positioned within the second through channel; and a flange integrally formed with the silencer housing at a discharge end of the silencer device; and an exhaust-gas outlet cover coupled to the exhaust-gas outlet-side housing such that the flange is intermediate the exhaust-gas outlet cover and the exhaust-gas outlet-side housing.

6. The exhaust-gas purification device according to claim 5, wherein the flange is in direct contact with the exhaust-gas outlet cover and the exhaust-gas outlet-side housing.

7. The exhaust-gas purification device according to claim 5, further comprising:

a first inner casing positioned at least partially within the first through channel and defining a third through channel; and a second inner casing positioned at least partially within the second through channel and defining a fourth through channel.

8. The exhaust-gas purification device according to claim 7, wherein the portion of the silencer housing is positioned within the fourth through channel.

9. The exhaust-gas purification device according to claim 8, wherein another portion of the silencer housing is positioned within the first through channel and the third through channel.

10. The exhaust-gas purification device according to claim 8, wherein the silencer housing extends through the first opening and the second opening.

11. The exhaust-gas purification device according to claim 5, wherein the exhaust-gas inlet-side housing is contact with the exhaust-gas outlet-side housing.

* * * * *